US006174297B1

(12) United States Patent
Chen

(10) Patent No.: US 6,174,297 B1
(45) Date of Patent: Jan. 16, 2001

(54) BATH SCRUBBER WITH MASSAGE BALLS

(76) Inventor: Kuo-Chin Chen, 2-1 Fl., No.18, Alley 47 ,Lane 208, Jui An Street, Ta An District, Taipei (TW)

( * ) Notice: Under 35 U.S.C. 154(b), the term of this patent shall be extended for 0 days.

(21) Appl. No.: 09/287,581

(22) Filed: Apr. 6, 1999

(51) Int. Cl.[7] ..... A61H 15/00

(52) U.S. Cl. ..... 601/128; 601/131; 601/136; 601/137; 601/132; 15/222; 15/209.1

(58) Field of Search ..... 601/121, 122, 601/124, 125, 128, 129, 131, 132, 133, 134, 135, 136, 137, 138; 15/209.1, 210.1, 222; D24/211, 214; 482/49; 401/6–8

(56) References Cited

U.S. PATENT DOCUMENTS 3,377,121 * 4/1968 Billesbach et al. ..... 15/222
3,977,796 * 8/1976 Gillespie et al. ..... 401/8
4,169,466 * 10/1979 Wong ..... 601/122
5,545,456 * 8/1996 Suida ..... 15/222
5,736,213 * 4/1998 Meier ..... 15/222
5,898,968 * 5/1999 Beattie ..... 15/210.1

* cited by examiner

*Primary Examiner*—Justine R. Yu
(74) *Attorney, Agent, or Firm*—Pro-Techtor International Services

(57) ABSTRACT

A bath scrubber mainly includes a front nylon piece and a back piece that are sewed up to form a bag defining a unitary inner space for accommodating a plurality of massage balls therein. Restricting means are provided on the back piece and the front nylon piece at positions between any four adjacent massage balls. The restricting means divide the unitary inner space defined by the bag of the bath scrubber into several smaller spaces that each confines a massage ball therein but allows the massage ball to freely and smoothly rotate when the bath scrubber is moved on a user's skin to and fro for cleansing purpose. The bath scrubber with massage balls restricted in separated small spaces can therefore not only hold more bubbles to achieve enhanced cleaning effect but also provide good massage effect.

4 Claims, 12 Drawing Sheets

BATH SCRUBBER WITH MASSAGE BALLS

BACKGROUND OF THE INVENTION

The present invention relates to a bag-like bath scrubber having massage balls received therein, and more particularly to a bag-like bath scrubber having more than one row of massage balls separately and rotatably fitted in divided spaces in the bath scrubber.

A conventional bag-like bath scrubber with massage balls, as the one shown in FIG. 18, mainly includes several superposed layers of inner nets 11 and a layer of outer net 12. Some massage balls 40 are put into a large space defined by the inner nets 11. Strings 41 are used to tighten portions of the inner nets 11 between any two adjacent massage balls 40 as well as two outer ends of the inner nets 11, so that the massage balls 40 are arranged in a straight line but separately rotatably confined in a small space in the inner nets 11. The inner nets 11 containing the massage balls 40 are then covered with the outer net 12. Two open ends of the superposed inner nets 11 and outer net 12 are tightened by binding strings (not shown) threaded through meshes of the nets along circumferential edges of the open ends and then knotted. Two loops 20 are separately provided in the open ends of the superposed inner and outer nets 11, 12 with the binding strings extended through them, such that the loops 20 are integrally attached to the nets 11, 12 with any knots 21 on the loops 20 invisible from outside of the bath scrubber.

Following are some drawbacks of the above-described conventional bath scrubber with massage balls:

1. The massage balls 40 are separately restricted in small spaces in the inner nets 11 by tying strings 41 around the nets 11 between two adjacent massage balls 40. The massage balls 40 might not be able to rotate freely and provide good massage effect if the nets 11 are too tightly tied. On the other hand, the massage balls 40 might undesirably come into contact with one another and/or form big lumps in the nets 11 to cause discomfort to a user if the nets 11 are too loosely tied.
2. To avoid forming lumps in the bath scrubber, only one row of massage balls 40 are provided in the bath scrubber by confining each massage ball in a small space in the inner nets 11 formed by tying strings 41 around the nets 11. Therefore, there is only limited and narrow contact area on the bath scrubber between the massage balls 40 and a user's skin.
3. Due to the layer of outer net 12 that is loosely covered over the inner nets 11, the massage balls 40 in the inner nets 11 might not be able to freely rotate in the small spaces to massage the user while the user uses the bath scrubber to clean his or her skin.

It is therefore tried by the inventor to develop an improved bag-like bath scrubber to eliminate the drawbacks existing in the conventional bath scrubber and to provide better cleaning and massage effects.

SUMMARY OF THE INVENTION

A primary object of the present invention is to provide a bag-like bath scrubber having massage balls fitted therein in manners that allow each massage ball to rotate freely and smoothly only in a specific restricted space when a user is using the bath scrubber to clean skin.

Another object of the present invention is to provide a bag-like bath scrubber having massage balls fitted therein in manners that allow the massage balls to be arranged in the bag-like bath scrubber in more than one row to provide increased contact area on the bath scrubber between the massage balls and the user's skin.

To achieve the above and other objects, the big-like bath scrubber of the present invention mainly includes a bag formed from a back piece, a front nylon piece, and a border strip that are sewed up in predetermined sequences, and a plurality of massage balls fitted in a space defined by the bag-like bath scrubber.

The initially formed bag has an open end with a flap extended from the back piece. The massage balls are positioned into the bag via the open end before the flap is turned and sewed onto the bag to seal the open end. The flap is so turned and sewed onto the bag that a narrow space is left between it and the sealed open end for a cord to extend therethrough before the cord is knotted to form a loop for conveniently hanging the bag-like bath scrubber at a desired position.

In a preferred embodiment, the massage balls are positioned in the bag of the bath scrubber in two rows. The two rows of massage balls are individually fixed in place by providing restricting means on the back piece and the front nylon piece at positions among any four adjacent massage balls. The restricting means divide the space defined by the bag of the bath scrubber into several smaller spaces that each confines a massage ball therein but allows the massage ball to freely and smoothly rotate when the bag is moved on the user's skin to and fro to clean the skin. These arrangements enable the bath scrubber to hold more cleansing bubbles and provide improved massage effect.

BRIEF DESCRIPTION OF THE DRAWINGS

The above and other objects and the features and functions of the present invention may be best understood by referring to the following detailed description of the preferred embodiments and the accompanying drawings, wherein.

DETAILED DESCRIPTION OF THE PREFERRED EMBODIMENTS

Figure 1:
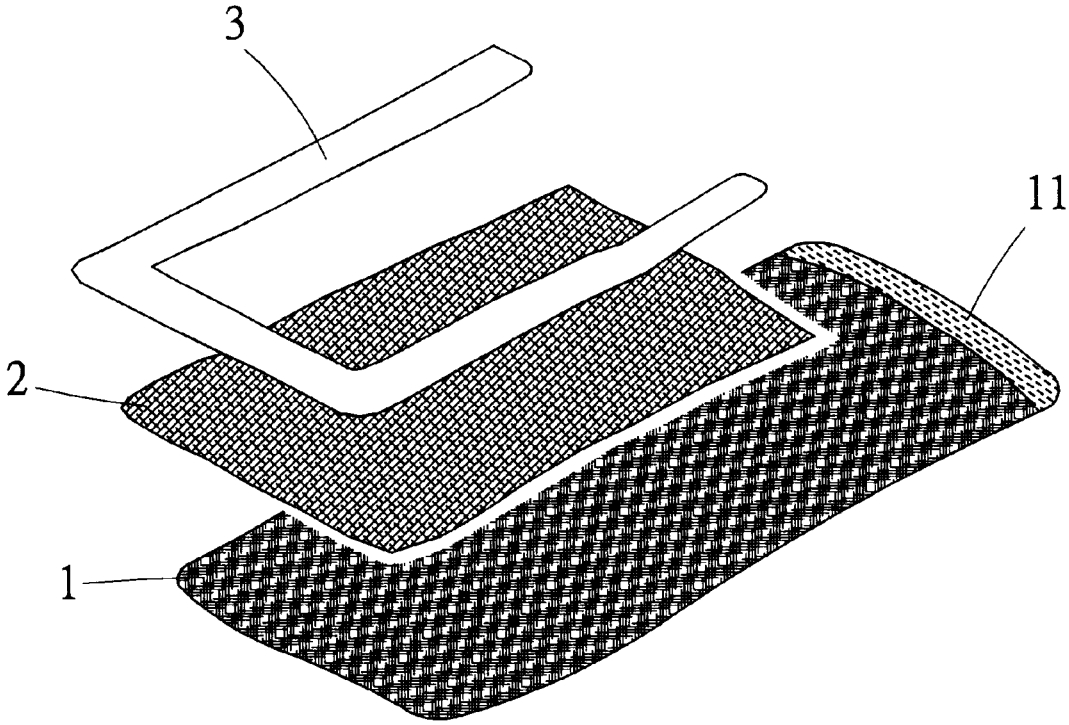
FIG. 1 is an exploded perspective of a bag for the bath scrubber according to the present invention.

Please refer to FIG. 1 that is an exploded perspective of a bag for forming the bath scrubber of the present invention. As shown, the bag includes a back piece 1, a front nylon piece 2, and a border strip 3 that are sewed up in predetermined sequences to form the bag. The back piece 1 may be selected from any suitable material and has a sewing edge 11 provided at one end thereof. The front nylon piece 2 is preferably selected from nylon materials having good elasticity for easy stretch and quick restoration from a stretched state and is shorter than the back piece 1. In the illustrated embodiment, the back piece 1 and the front nylon piece 2 are in rectangular shape, and the border strip 3 has a length long enough for sealing three edges of the bag.

Figure 2:
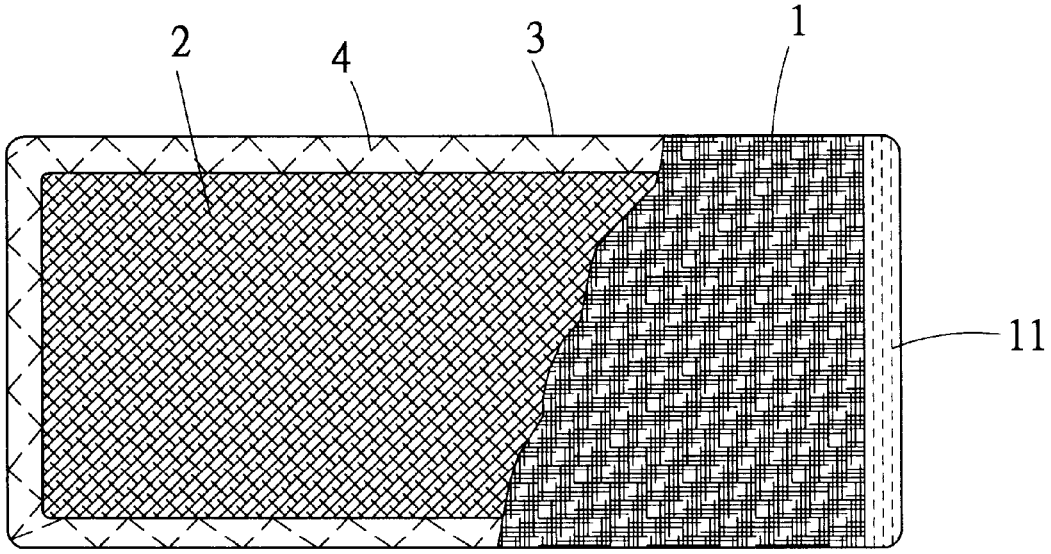
FIG. 2 is an assembled perspective of the bag of FIG. 1 with a part of the bottom piece removed to better show a structure thereof.

FIG. 2 is a bottom view of the bag formed from the back piece 1, the front nylon piece 2, and the border strip 3 of FIG. 1. A part of the back piece 1 is removed to better show the sequential relation of these three elements. As shown, the front nylon piece 2 is overlaid on the back piece 1 opposite to the sewing edge 11, so that a small length of the back piece 1 between the sewing edge 11 and the front nylon piece 2 forms a flap. The border strip 3 is positioned on the front nylon piece 2 to overlap three edges of the front nylon piece 2 that are not adjacent to the flap of the back piece 1. The border strip 3, the front nylon piece 2, and the back piece 1 are then sewed up with threads 4 along their three overlapped edges to form the bag having an opening adjacent to the flap and facing the sewing edge 11 of the back piece 1. The front nylon piece 2 is a multi-ply fabric and each ply thereof has a plurality of meshes. The meshes on the multiple plies of the front nylon piece 2 overlap one another to define numerous very small irregular spaces that tend to change in shape and dimensions when the front nylon piece 2 is stretched or compressed and therefore, enable the front nylon piece 2 to hold more bubbles of cleansing product to achieve enhanced cleaning effect.

Figure 3:
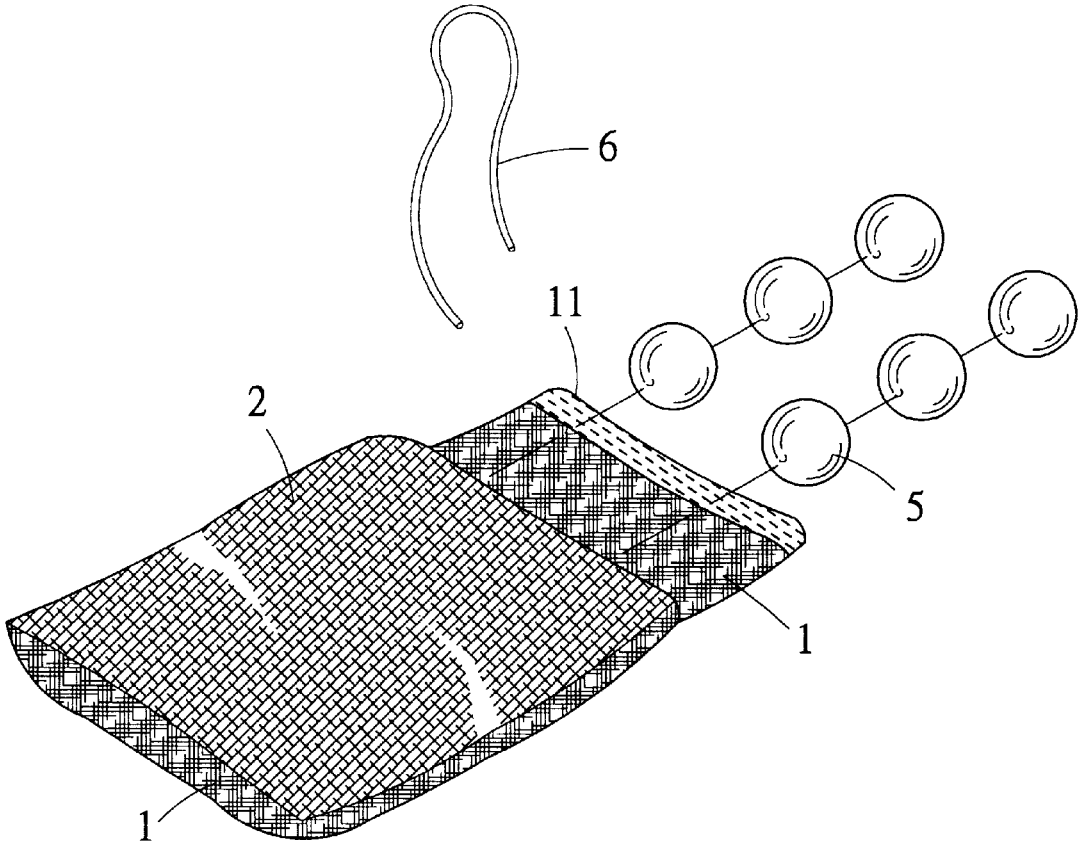
FIG. 3 is a perspective of the bag of FIG. 2 turned inside out to define a space for receiving some massage balls therein.

Please refer to FIG. 3. The bag formed in the manner described in FIG. 2 is turned inside out so that the three sewed-up edges are invisible from outside. The completed bag defines a big unitary inner space in which a plurality of massage balls 5 can be accommodated. The massage balls 5 are preferably in even numbers so that they maybe arranged in the bag in two symmetrical rows. Thereafter, the flap is folded toward the front nylon piece 2 with the sewing edge 11 fitly lying on an edge of the front nylon piece 2 adjacent to the opening, so as to close the opening of the bag. The sewing edge 11 and the opening are then sewed up with threads to seal the massage balls 5 in the bag. A narrow space is left between a folding line of the flap and the sealed opening for a cord 6 to thread therethrough. The cord 6 is knotted at two ends to form a loop attached to one end of the sealed bag.

Figure 4:
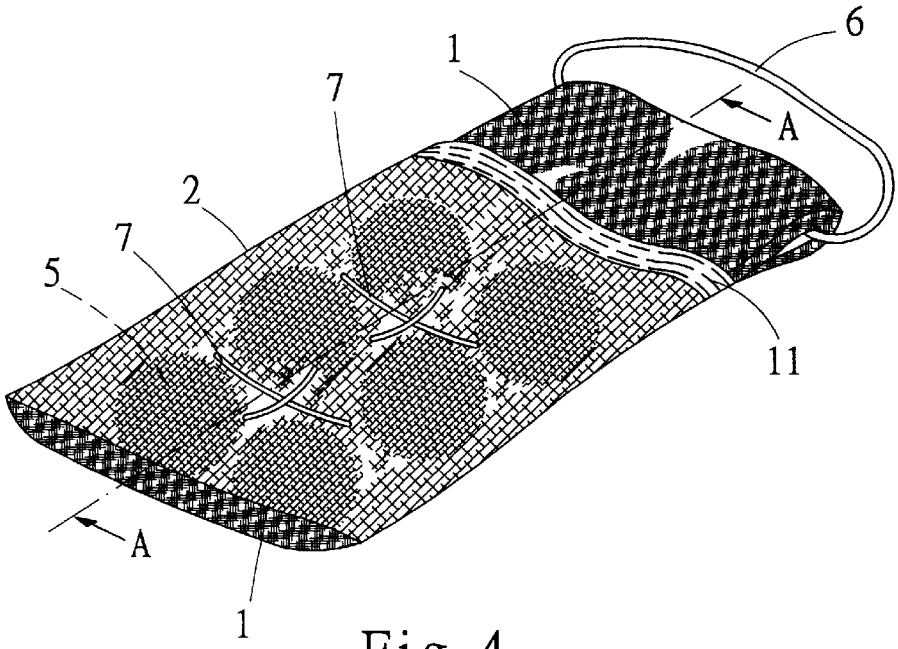
FIG. 4 is a perspective of a bath scrubber formed from the bag of FIG. 2 with the massage balls fixed in the bag.
Figure 5:
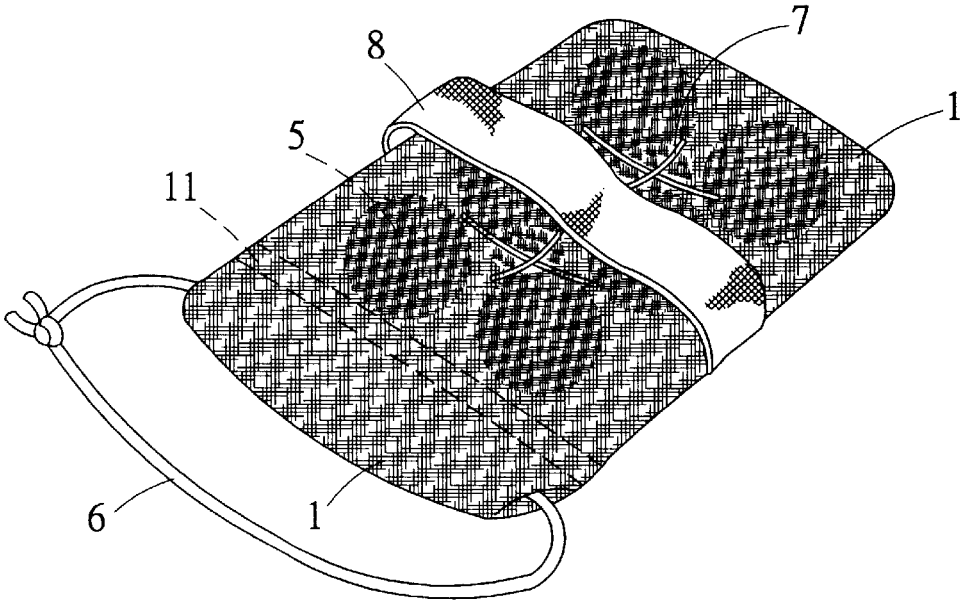
FIG. 5 is the bath scrubber of FIG. 4 viewed from the other side thereof.
Figure 6:
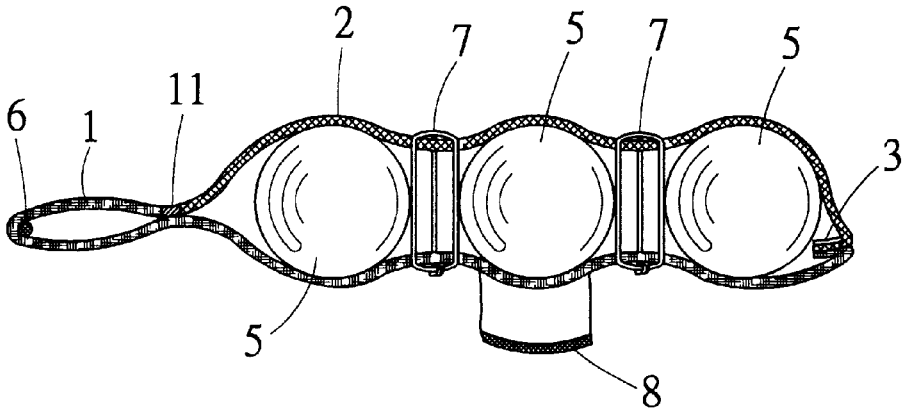
FIG. 6 is a cross section taken on line A—A of FIG. 4.

Please refer to FIGS. 4, 5, and 6 at the same time. Strings 7 in adequate lengths are separately threaded up and down to sew up the front nylon piece 2 and the back piece 1 in such a manner that the strings 7 intersect at least at positions located between any four adjacent massage balls 5. The strings 7 sewed up the back piece 1 and the front nylon piece 2 and intersected between the massage balls 5 divide the big unitary inner space of the bag into several smaller spaces for each restricting a massage ball 5 therein. The massage ball 5 restricted in each smaller inner space is allowed to freely and smoothly rotate without moving out of the particular smaller space. That is, the massage balls 5 are separated from one another in the bag and would not crowd into one small corner in the bag to form a big lump. A band 8 is connected at two ends to two middle points on two lateral sides of the bag, so that the band 8 faces and extends across the back piece 1. A user may extend his or her one palm below the band 8 to press the bag against body skin without the need to tightly grip the whole bath scrubber.

The front nylon piece 2 serves as a cleansing surface of the bath scrubber. The back piece 1 is a surface of the bath scrubber that directly contacts with the user's hand. It is preferable the back piece 1 is made of a material that generates minor frictional resistance when contacting with the user's hand. As mentioned above, the front nylon piece 2 includes numerous meshes that overlap one another to define many small irregular spaces. When the bath scrubber is moved to and fro on the user's skin, these meshes and the small irregular spaces defined by them enable the front nylon piece 2 to hold more cleansing bubbles to effectively scrub and clean the user's skin. Meanwhile, the massage balls 5 restricted in the smaller inner spaces of the bag of the bath scrubber separately rotate and contact with the user's skin through the front nylon piece 2 to massage the skin. The rotation of the massage balls 5 causes the meshes of the front nylon piece 2 to be stretched or compressed and therefore have continuous changes in their shapes and dimensions. Such changes in shapes and dimensions of the meshes enable the bath scrubber to more effectively remove dust and/or grease from the skin.

Figure 7:
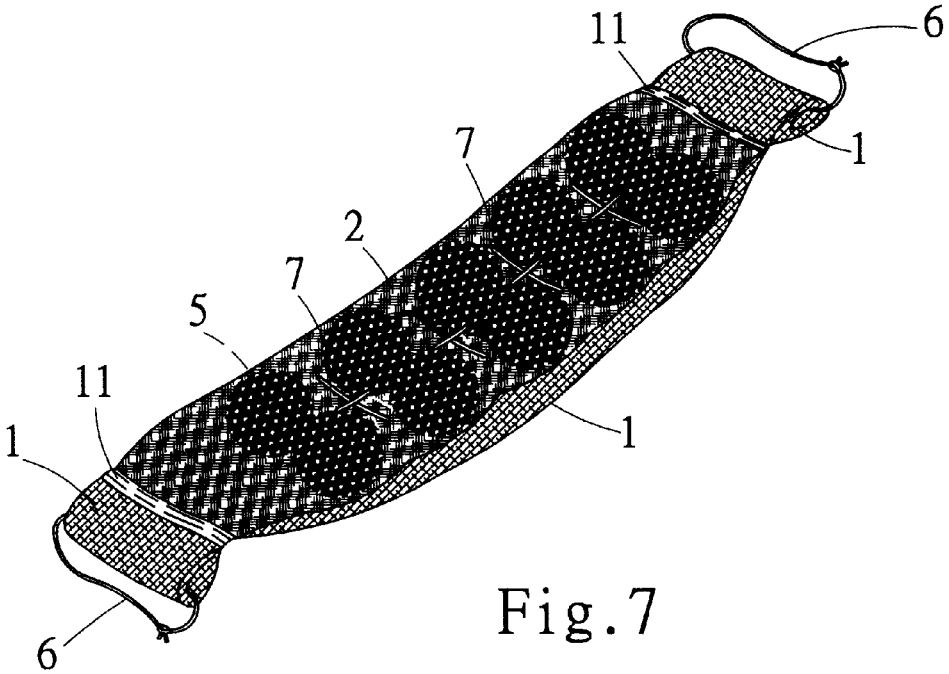
FIG. 7 is a perspective of a bath scrubber according to a second embodiment of the present invention.

FIG. 7 illustrates another embodiment of the present invention. In this embodiment, the bag forming the bath scrubber is in a form of long belt, so that more massage balls may be included in each row in the bag. And, the back piece 1 has flaps and sewing edge 11 provided at both ends, so that two narrow spaces are formed at two ends of the bath scrubber for two cords 6 to thread through and form two loops. This type of lengthened bath scrubber with more massage balls is particularly suitable for scrubbing and cleaning the user's back.

Figure 8:
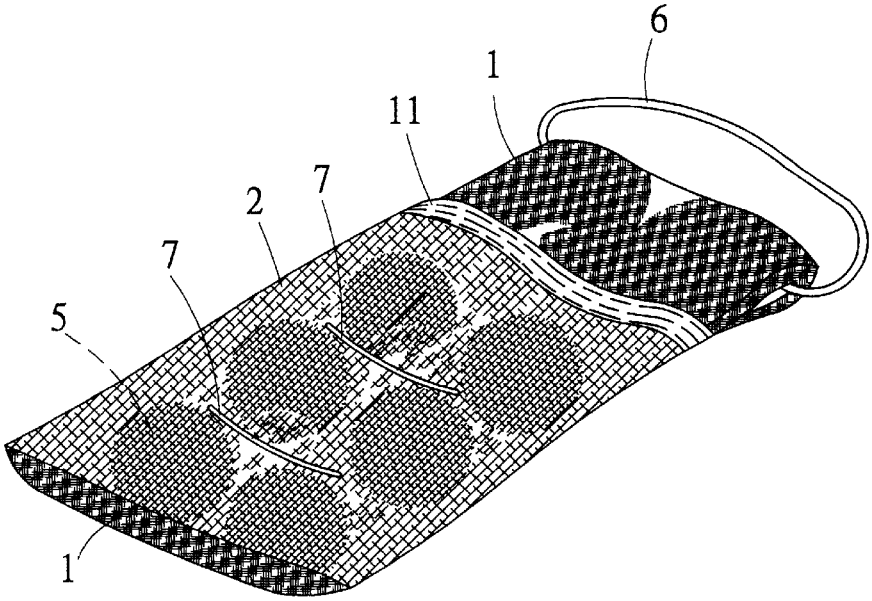
FIG. 8 is another bath scrubber similar to that of FIG. 4 with the massage balls fixed therein in a different manner.
Figure 9:
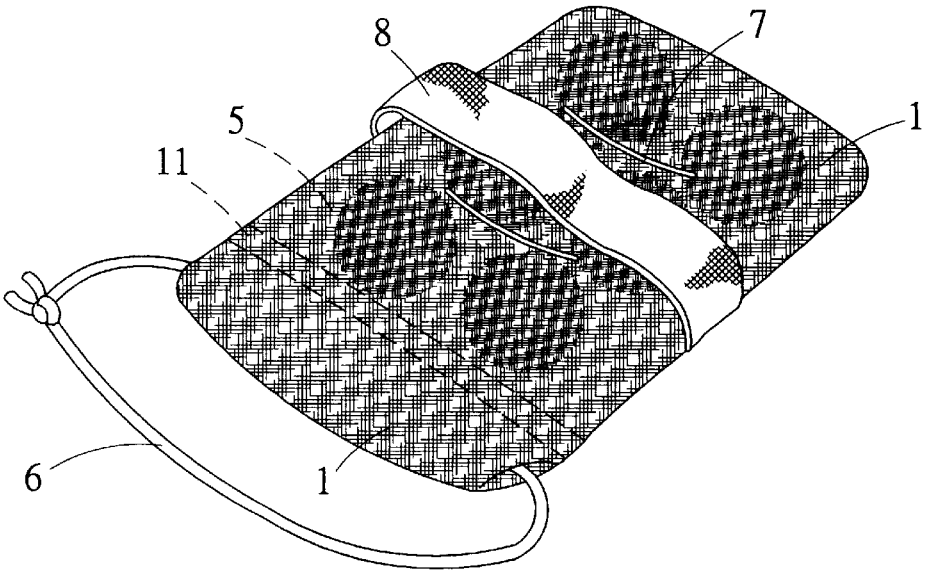
FIG. 9 is the bath scrubber of FIG. 8 viewed from the other side thereof.
Figure 10:
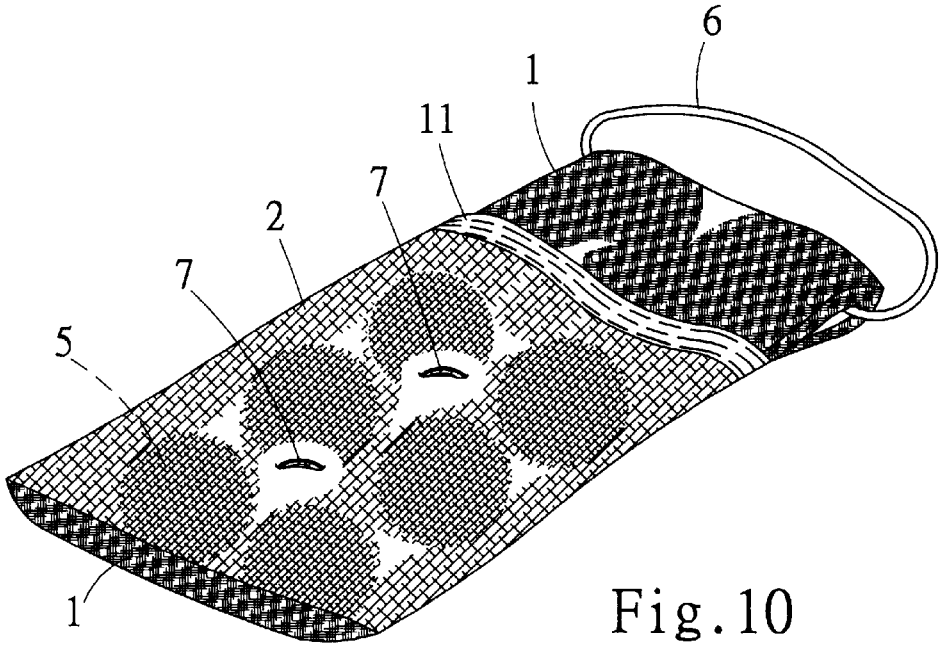
FIG. 10 is still another bath scrubber similar to that of FIGS. 4 and 8 with the massage balls fixed therein in a different manner.
Figure 11:
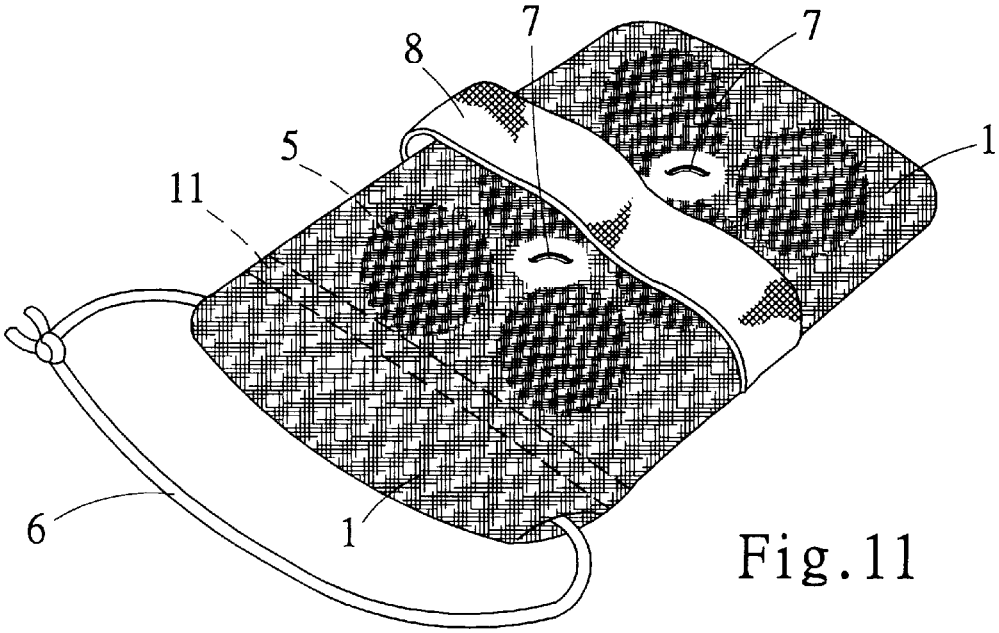
FIG. 11 is the bath scrubber of FIG. 10 viewed from the other side thereof.

It is to be noted that it is not necessarily for the strings 7 to intersect between any four adjacent massage balls 5 to achieve the purpose of restricting the massage balls 5 in their respective smaller inner space. For example, it is also possible to stitch the strings 7 so that they transversely extend between two massage balls 5 in each row, as shown in FIGS. 8 and 9. Alternatively, it is possible to stitch the strings 7 so that they diagonally extend across the space between any four adjacent massage balls 5, as shown in FIGS. 10 and 11. The same restricting effect can be achieved in either way mentioned above.

Figure 12:
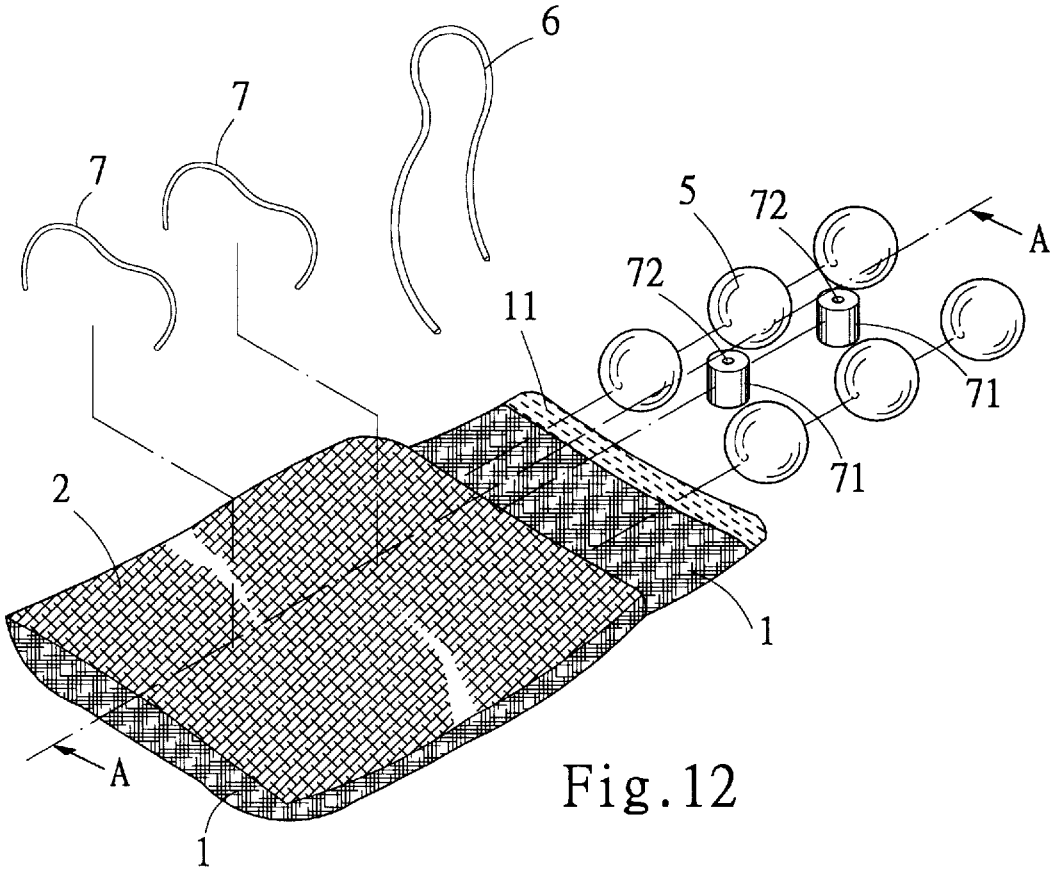
FIG. 12 is still another bath scrubber similar to that of FIGS. 4, 8, and 10 with the massage balls fixed therein in a different manner.
Figure 13:
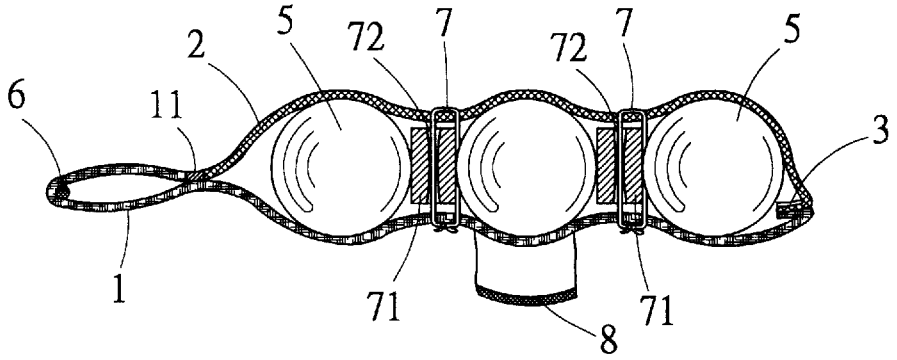
FIG. 13 is a cross section taken on line A—A of FIG. 12.

It is also to be noted means other than the strings 7 may be used to achieve the same purpose of restricting the massage balls 5 in separated smaller spaces. FIG. 12 is a partially exploded perspective of a third embodiment of the present invention and FIG. 13 is a cross section taken on line A—A of FIG. 12. This third embodiment is similar to the first preferred embodiment shown in FIG. 4, except that a short cylinder 71 smaller than the massage ball 5 and having a central through hole 72 is disposed in the bag at each space between four adjacent massage balls 5 and is fixed thereto by a string 7 guided through the hole 72 and the front nylon piece 2 and the back piece 1 and knotted.

Figure 14:
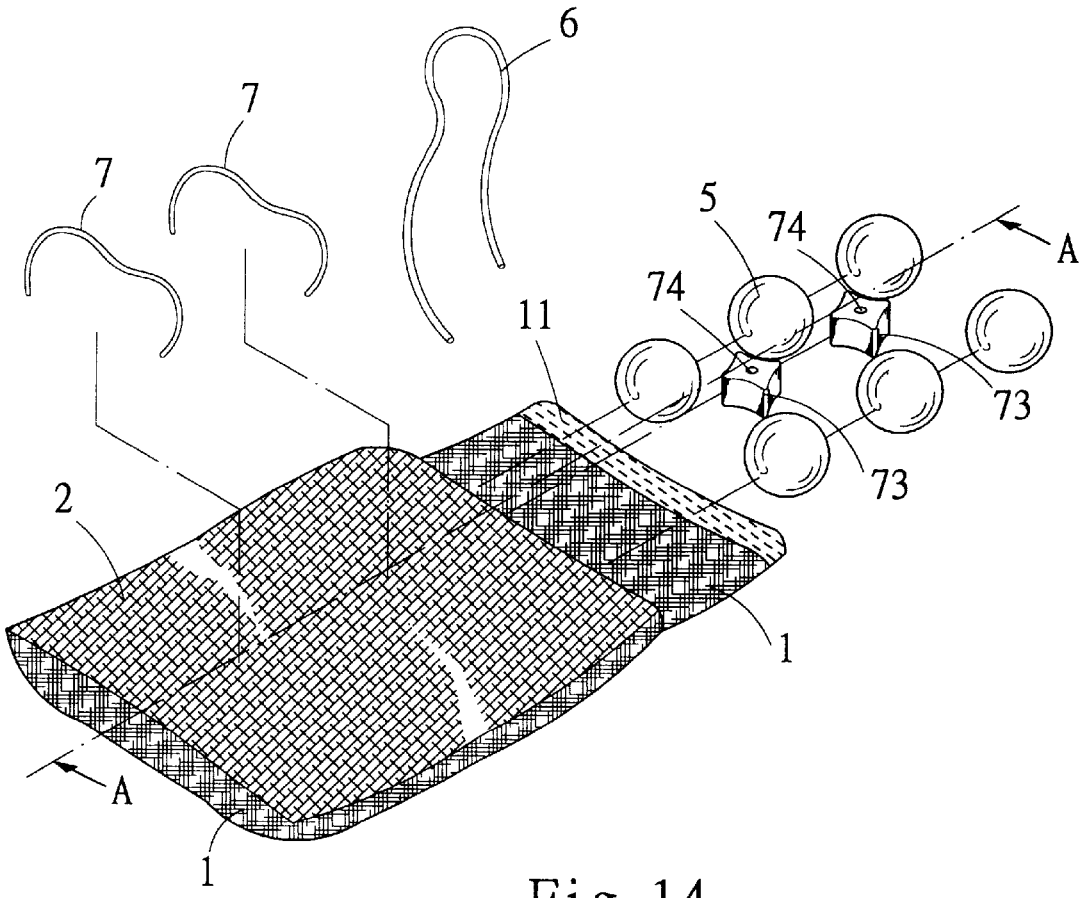
FIG. 14 is still another bath scrubber similar to that of FIGS. 4, 8, 10, and 12 with the massage balls fixed therein in a different manner.
Figure 15:
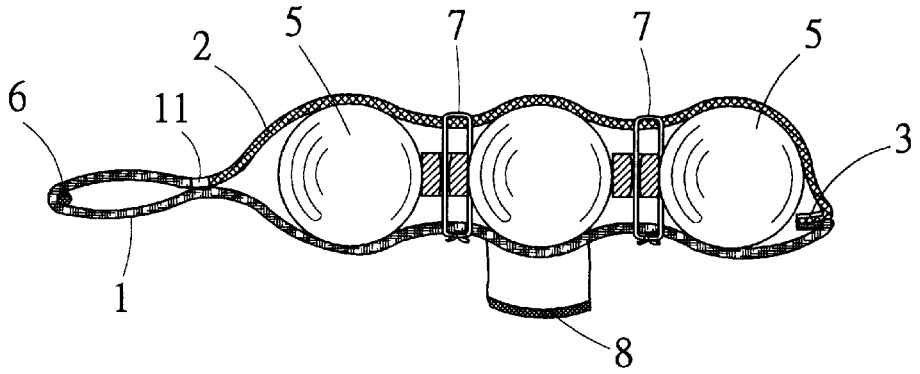
FIG. 15 is a cross section taken on line A—A of FIG. 14.

FIGS. 14 and 15 illustrate partially exploded perspective and sectional views, respectively, of a fourth embodiment of the present invention. This fourth embodiment is similar to the previous embodiments, except that a generally square block 73 smaller than the massage ball 5 and having a central through hole 74 is disposed in the bag at each space between four adjacent massage balls 5 and is fixed thereto by a string 7 guided through the hole 74 and the front nylon piece 2 and the back piece 1 and knotted.

Figure 16:
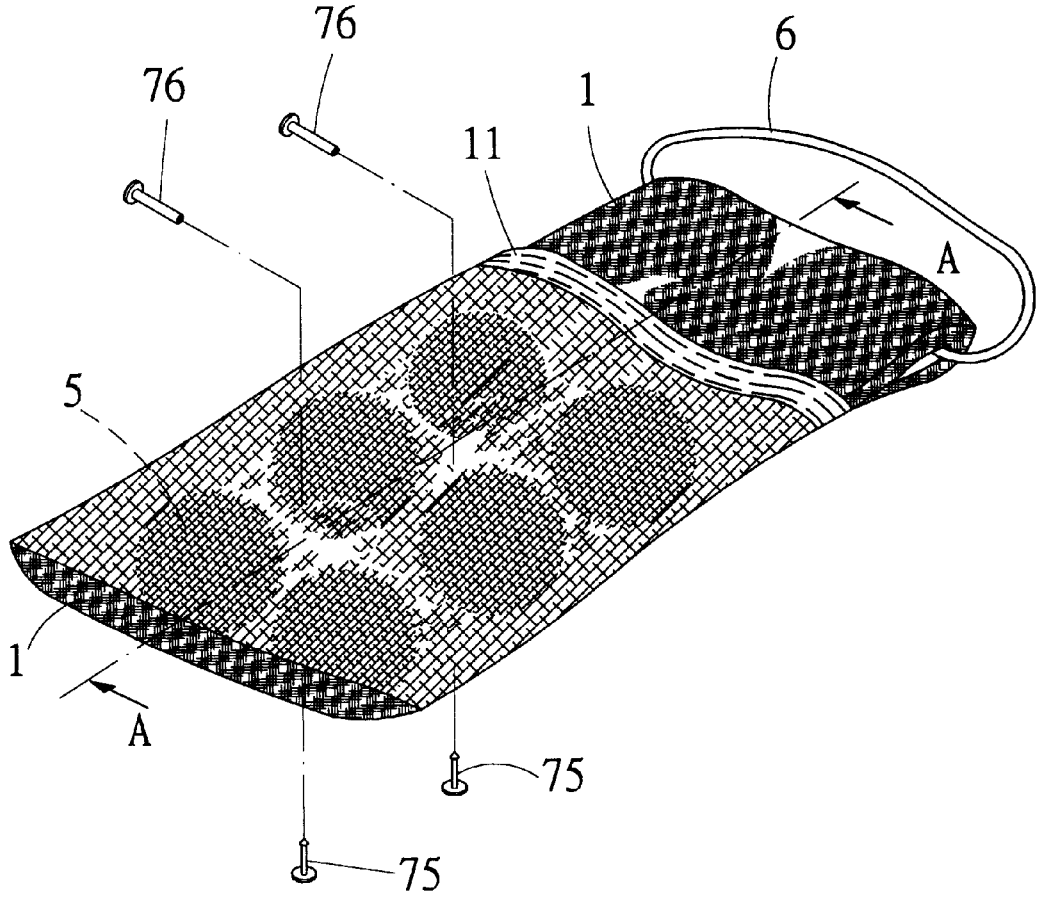
FIG. 16 is still another bath scrubber similar to that of FIGS. 4, 8, 10, 12, and 14 with the massage balls fixed therein in a different manner.
Figure 17:
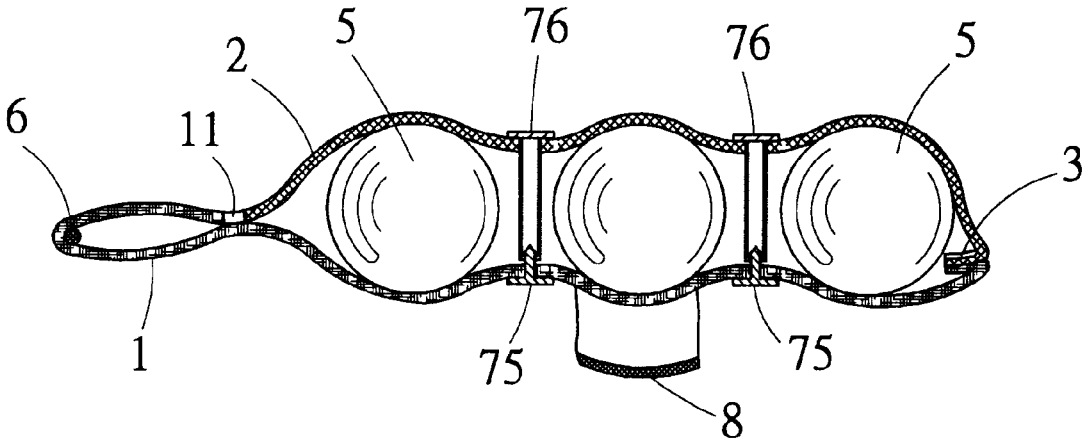
FIG. 17 is a cross section taken on line A—A of FIG. 16.
Figure 18:
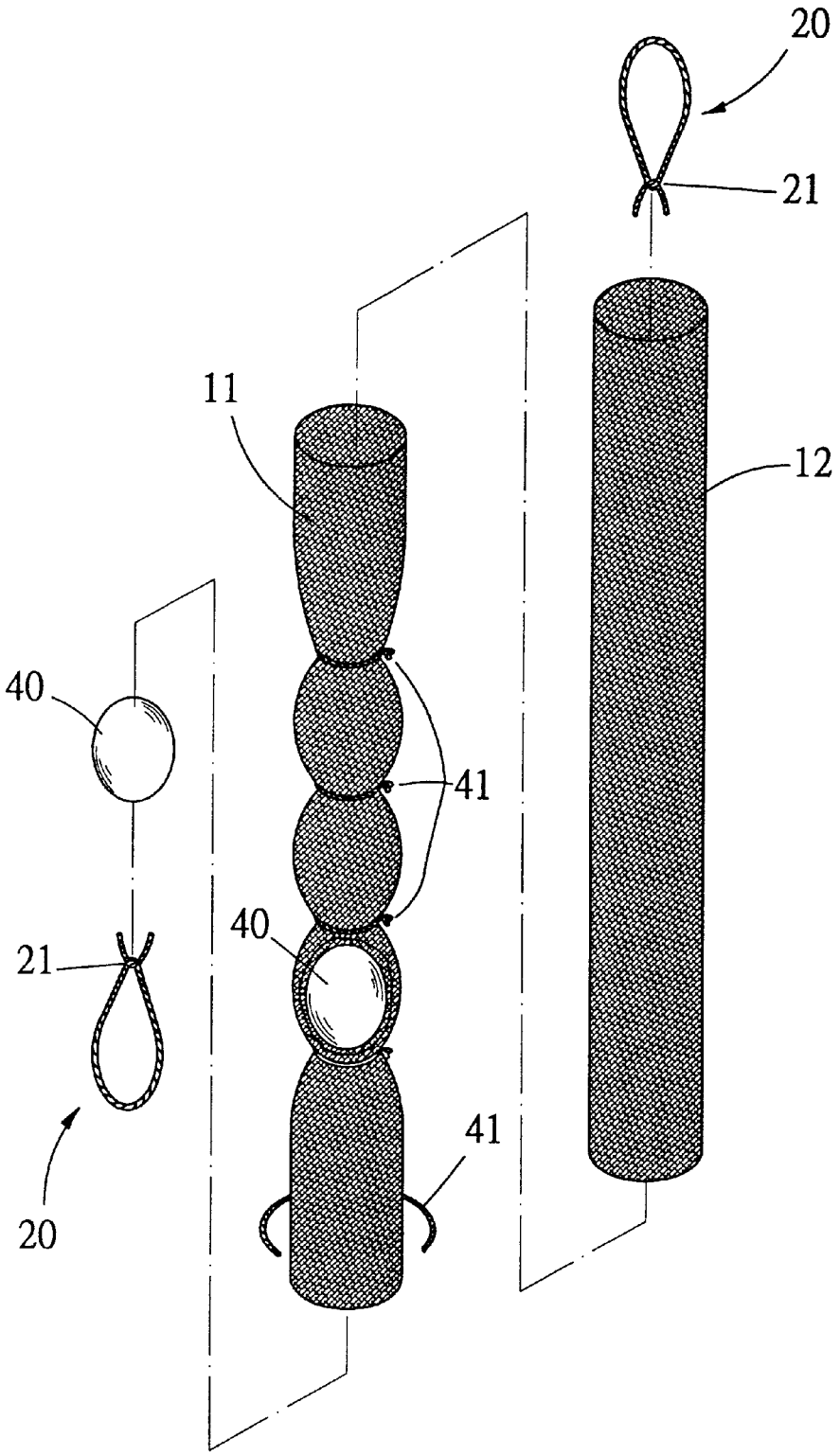
(PRIOR ART) Fig.18
FIG. 18 is an exploded perspective of a conventional bath scrubber with massage balls.

FIGS. 16 and 17 illustrate perspective and sectional views, respectively, of a fifth embodiment of the present invention. This fifth embodiment is similar to the previous embodiments, except that a set of male and female connectors 75, 76 are oppositely extended through two corresponding points on the back piece 1 and the front nylon piece 2 between any four adjacent massage balls 5 to connect to each other and thereby divide the unitary inner space of the bag into several smaller spaces to each restrict a massage ball 5 therein.

With the above arrangements, the bath scrubber of the present invention has following advantageous features:

1. The inner space of the bag forming the bath scrubber can be easily divided into desired numbers of smaller spaces either by the strings, 7, the short cylinders 71, the square blocks 73, or the male and female connectors 75 and 76. Each of the smaller spaces confines a massage ball 5 therein but allows the massage ball 5 to freely rotate only in that particular small space. Therefore, the front nylon piece 2 and the freely rotatable massage balls 5 together enable the bath scrubber of the present invention to effectively scrub and clean and massage the user's skin.
2. All the different types of massage ball restricting means, including the strings 7, the short cylinders 71, the square blocks 73, and the male and female connectors 75 and 76, allow the massage balls 5 to be arranged in the bag of the bath scrubber in two or more rows. Therefore, an increased contact area on the bath scrubber between the massage balls and the user's skin may be achieved to enhance the massage effect of the present invention.

What is claimed is:

1. A bath scrubber with massage balls comprising:

a nylon bag defining a unitary inner space said bag comprising a back piece having at least one extended end portion and at least one opening a plurality of massage balls contained in said bag, said at least one extended end portion of said back piece forming at least one flap, said at least one flap being folded to close said at least one opening of said bag so that said massage balls are sealed in said bag, a narrow space being formed at an end of said bag, said narrow space receives a cord, restricting means that divide said inner space into a plurality of compartments, each of said compartments contains one of said massage balls, each of said massage balls being freely rotatable within said compartments such that said bath scrubber cleans and massages a user's skin, said compartments are arranged in at least two rows so that at least two rows of massaging balls are included in said bath scrubber.

2. The bath scrubber with massage balls as claimed in claim 1, wherein:

said restricting means are strings.

3. The bath scrubber with massage balls as claimed in claim 1, wherein:

said compartments are arranged in straight lines.

4. The bath scrubber with massage balls as claimed in claim 1, wherein:

said bag includes a border strip that reinforces seams of said bag.

* * * * *